US007542687B2

(12) United States Patent
Ai

(10) Patent No.: US 7,542,687 B2
(45) Date of Patent: Jun. 2, 2009

(54) IMAGE FORMING APPARATUS AND CONTROL METHOD OF THE IMAGE FORMING APPARATUS

(75) Inventor: Ryuta Ai, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 611 days.

(21) Appl. No.: 11/447,401

(22) Filed: Jun. 6, 2006

(65) Prior Publication Data

US 2007/0047979 A1 Mar. 1, 2007

(30) Foreign Application Priority Data

Aug. 31, 2005 (JP) ..... 2005-251650

(51) Int. Cl.
*B65H 3/44* (2006.01)
*G03G 21/00* (2006.01)

(52) U.S. Cl. ..... 399/23; 399/393; 399/391; 400/624

(58) Field of Classification Search ..... None
See application file for complete search history.

(56) References Cited

U.S. PATENT DOCUMENTS 4,008,957 A * 2/1977 Summers ..... 399/23
5,028,041 A * 7/1991 Kobayashi ..... 271/9.03
6,125,242 A * 9/2000 Yamada ..... 399/23
6,567,620 B2 5/2003 Brown, Jr. et al.
6,957,025 B1 * 10/2005 Sinn et al. ..... 399/84

FOREIGN PATENT DOCUMENTS

JP 7-121080 A 5/1995
JP 2000267520 A * 9/2000
JP 2005049516 A * 2/2005

* cited by examiner

*Primary Examiner*—Daniel J Colilla
(74) *Attorney, Agent, or Firm*—Canon USA Inc IP Div

(57) ABSTRACT

An image forming apparatus including a plurality of container units containing sheets, a sheet feeding device provided for each of the plurality of container units and configured to feed the sheets; and a controller switching between modes including a first mode and a second mode in order to automatically switch a sheet feeding position from a container unit in current use to another container unit. In the first mode, the sheet feeding position is switched to the other container unit in the state in which a prescribed amount of sheets are left in the container unit in current use, and in the second mode, the sheet feeding position is switched to the other container unit after the sheets in the container unit in current use are exhausted.

13 Claims, 9 Drawing Sheets

IMAGE FORMING APPARATUS AND CONTROL METHOD OF THE IMAGE FORMING APPARATUS

BACKGROUND OF THE INVENTION

1. Field of the Invention

The present invention relates to an image forming apparatus, such as a copying machine, printer, facsimile machine and the like, and a control method thereof. More particularly, the present invention relates to an auto cassette changer to automatically change a sheet feeding position from a container unit in current use to another container unit.

2. Description of the Related Art

Recently, there is a need in an image forming apparatus using an electro-photographic process to form an image of high quality on a variety of sheets of plain paper, thick paper, thin paper, OHP and the like (hereinafter, simply referred to as "paper"). To address such need, a method employing an intermediate transfer member has widely been used, wherein images of respective colors of yellow (Y), magenta (M), cyan (C), and black (K) are transferred onto the intermediate transfer member, and an image is formed by overlaying the toner images one on another and transferred as a whole onto a sheet of paper. By using the intermediate transfer member, the transfer onto the paper can be made at one time, which can minimize the influence on transfer efficiency onto the paper so that an image of high quality is obtained.

Meanwhile, in recent years, it has been desirable to adapt the image forming apparatus using the electro-photographic process to the POD (Printing On Demand) market. In the POD market, there is a need for a technique that allows a user to obtain image outputs of a required amount when needed. Thus, technical developments have vigorously been made, based on the electro-photographic process and using the intermediate transfer member, at more rapid and stable formation of an image of better quality.

A conventional image forming apparatus is generally provided with the so-called auto cassette change (ACC) function. According to the auto cassette change (ACC), when a plurality of container units containing sheets of paper are provided having the sheets of the same size set therein, in the event that the container unit in current use becomes empty or attains a paper out state during a continuous copying operation, the container unit is automatically switched to another container unit, while giving a warning to continue the image forming operation.

When the auto cassette change function is employed in the image forming apparatus using the intermediate transfer member, the distance from the point where a latent image is written onto an image bearing member to the point where the images are collectively transferred onto a sheet of paper increases. With the increase in this distance, the time from when the image is written to when it is transferred onto the sheet of paper (image transfer time) increases.

If this image transfer time is longer than the time from initiation of the operation of feeding a sheet of paper from a container unit to the timing when the image is transferred onto the sheet (sheet transfer time), the image will have already been formed on the image bearing member when a sheet is fed from the container unit. That is, at the time when the paper out state within the container unit is detected, image formation has already been started, in which case the sheet feeding operation from a next container unit cannot be made in time.

In such case, if it is possible to check the amount of remaining sheets in the container unit to an accuracy of a single sheet, it would be possible to cause the other container unit to start the sheet feeding operation when the last sheet of paper is fed from the container unit in current use. In this case, the sheet can be fed in time even if the container unit is switched, allowing the image formation and image output to be continued. However, it is difficult to accurately detect the amount of remaining sheets in the container unit on a single sheet basis, for different kinds of paper having various basic weights.

U.S. Pat. No. 6,567,620 proposes an invention to address the problem, wherein when the amount of sheets in a container unit exceeds a prescribed threshold value, the gap between successive sheets is lengthened to lower the productivity level so as to prepare for feeding sheets from a next container unit during that time, and the inter-page gap is narrowed again to resume the normal operation when the feeding of the sheets from the next container unit is started.

Further, Japanese Patent Laid-Open No. 07-121080 proposes another invention to address the problem, wherein when paper exhaustion in a container unit is detected, the sheet feeding operation is stopped, the image formed on the intermediate transfer member is separated from a transfer member while waiting for a sheet fed from a next container unit, and the transfer is carried out after the sheet feeding operation is restarted.

However, each of the inventions described in U.S. Pat. No. 6,567,620 and Japanese Patent Laid-Open No. 07-121080 provides a down time to perform the auto cassette change operation. Since high productivity is required in the POD market, occurrence of lower productivity due to the down time upon the auto cassette change is a problem the user wishes to avoid to the greatest possible extent.

SUMMARY OF THE INVENTION

The present invention is directed to an image forming apparatus that enables a sheet feeding operation in accordance with a user's intended purpose when automatically switching a sheet feeding operation from a container unit in current use to another container unit, and a control method of the image forming apparatus.

According to an aspect of the present invention, an image forming apparatus includes a plurality of container units adapted to contain sheets. The container units include a currently in-use container unit and another container unit. The apparatus also includes a sheet feeding device provided for each of the plurality of container units and configured to feed the sheets contained in the respective container unit. Further, the apparatus includes a controller switching between modes including a first mode and a second mode in order to automatically switch a sheet feeding position from the currently in-use container unit to the other container unit. In the first mode, the sheet feeding position is switched to the other container unit in the state in which a prescribed amount of sheets are left in the currently in-use container unit, and in the second mode, the sheet feeding position is switched to the other container unit after the sheets in the currently in-use container unit are exhausted.

According to another aspect of the present invention, a control method of an image forming apparatus having a plurality of container units containing sheets, including a currently in-use container unit and another container unit, and a sheet feeding device provided for each of the plurality of container units and configured to feed the sheets contained in the respective container unit, includes controlling switching between a first mode and a second mode in order to automatically switch a sheet feeding position from the currently in-use container unit to the other container unit. In the first mode, the sheet feeding position is switched to the other container unit in the state in which a prescribed amount of sheets are left in the currently in-use container unit, and in the second mode, the sheet feeding position is switched to the other container unit after the sheets in the currently in-use container unit are exhausted.

Further features of the present invention will become apparent from the following description of exemplary embodiments (with reference to the attached drawings).

DESCRIPTION OF THE EMBODIMENTS

Hereinafter, an embodiment of the present invention will be described in detail by way of example with reference to the drawings. It should be noted that the dimensions, materials, shapes, and relative arrangement of components described in the embodiment are not intended to restrict the scope of the invention thereto, unless otherwise specified.

Figure 1:
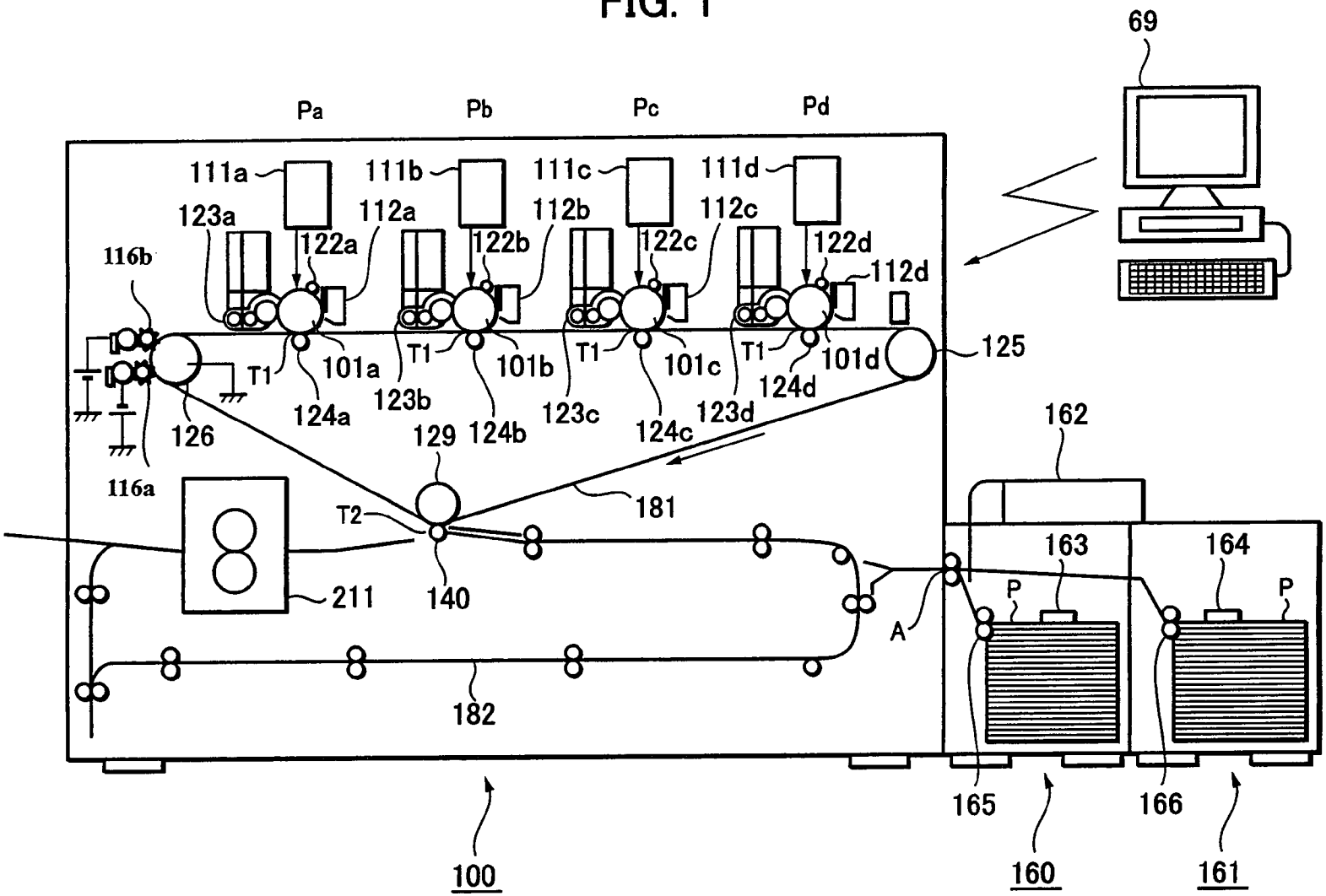
FIG. 1 is a schematic cross sectional view of an image forming apparatus according to an embodiment of the present invention.

An image forming apparatus 100 of the present embodiment includes at least two container units 160, 161, as shown in FIG. 1. Container unit 160 is provided with a sensor 163 that can sense the amount of remaining sheets of paper. Container unit 161 is similarly provided with a sensor 164 that can sense the amount of remaining sheets of paper. Sheet feeding rollers 165 and 166 are provided for container units 160 and 161, respectively.

An intermediate transfer member 181 is provided inside the main body of the apparatus. The intermediate transfer member 181 can have a peripheral length of about 2400 mm and can travel in the direction shown by an arrow at about 300 mm/second. This intermediate transfer member 181 can be an endless belt having an elastic surface layer.

The intermediate transfer member 181 is wound around a driving roller 125, a tension roller 126, and a backup roller 129 serving as support members. Further, four image forming portions Pa, Pb, Pc and Pd having similar configurations are arranged in series along the horizontal portion of the intermediate transfer member 181. The configuration of the image forming portion Pa will now be representatively described.

Image forming portion Pa includes an electro-photographic photosensitive member in the form of a drum (hereinafter referred to as "photosensitive drum") 101*a*, which is an image bearing member arranged in a rotatable manner. Process devices including a primary charger 122*a*, a developer 123*a*, and a cleaning device 112*a* are arranged around the photosensitive drum 101*a*.

The other image forming portions Pb, Pc and Pd have configurations similar to that of the image forming portion Pa, and include photosensitive drums 101*b*-101*d*, primary chargers 122*b*-122*d*, developers 123*b*-123*d*, and cleaning devices 112*b*-112*d*, respectively. The image forming portions Pa, Pb, Pc and Pd differ from each other in that they form toner images of different colors of yellow, magenta, cyan, and black, respectively.

The developers 123*a*-123*d* arranged in respective image forming portions Pa-Pd contain yellow toner, magenta toner, cyan toner, and black toner, respectively.

The photosensitive drum 101*a* is uniformly charged by the primary charger 122*a*. An image signal by the yellow component color of the original is irradiated from an exposure device 111*a* via a polygonal mirror or the like onto the photosensitive drum 101*a*, so that an electrostatic latent image is formed. Subsequently, the yellow toner is supplied from the developer 123*a*, and the electrostatic latent image is developed as a yellow toner image.

With the rotation of the photosensitive drum 101*a*, the toner image arrives at a primary transfer portion T1 where the photosensitive drum 101*a* comes into contact with the intermediate transfer member 181. When the toner image arrives at the primary transfer portion T1, a first transfer bias is applied from a primary transfer roller 124*a*, so that the yellow toner image is transferred to the intermediate transfer member 181.

The intermediate transfer member 181 bearing the yellow toner image is delivered to the next image forming portion Pb. At this time, in the image forming portion Pb, a magenta toner image formed on the photosensitive drum 101*b* in the same manner as described above is transferred to be overlaid on the yellow toner image.

Similarly, as the elastic intermediate transfer member 181 moves in the arrow direction to the image forming portions Pc and Pd, the cyan toner image and the black toner image, respectively, are overlaid on the preceding toner images at the corresponding transfer portions T1.

Thereafter, a sheet of paper P having been fed from the container unit 160 by the sheet feeding roller 165 arrives at a secondary transfer portion T2, where the toner images of four colors described above are transferred onto the sheet P by a transfer bias applied to a secondary transfer roller 140. The sheet P having the toner images transferred thereon is delivered to a fixing portion 211, where the toner images are fixed onto the sheet P by heat and pressure.

Transfer residual toner on the photosensitive member that failed to be transferred by the primary transfer rollers 124*a*-124*d* is cleaned by the cleaning devices 112*a*-112*d* of a blade type. Meanwhile, the transfer residual toner on the intermediate transfer member 181 that failed to be transferred by the secondary transfer roller 140 is cleaned by a first cleaning device 116*a* and a second cleaning device 116*b* of a fur brush type, which is then provided for the next image formation.

Hereinafter, the configurations of the respective portions will be described in turn, taking the image forming portion Pa as an example. The photosensitive drum 101*a* serving as an image bearing member can be formed of an aluminum cylinder of about 80 mm in diameter, which has an outer peripheral surface applied with an organic photoconductor layer (OPC: organic photosensitive compound). The photosensitive drum 101*a* has its both ends supported by a flange in a rotatable manner. A driving force from an unillustrated driving motor is transmitted to one end of the photosensitive drum 101*a*, to drive it to rotate in an counterclockwise direction in the figure.

The primary charger 122*a* can be an electrically conductive roller having a roller shape. This roller is placed in contact with the surface of the photosensitive drum 101*a*, and a charging bias voltage is applied by an unillustrated power source to uniformly charge the surface of the photosensitive drum 101*a* to a negative polarity.

The exposure device 111*a* can be an LED array having an unillustrated polygonal mirror mounted to its tip end and controlled to light up in accordance with an image signal by an unillustrated drive circuit.

The developer 123*a* has an unillustrated toner container portion that contains negatively charged toner of the yellow color. The developer 123*a* is formed, e.g., of a developing roller, which is arranged adjacent to the surface of the photosensitive drum 101*a* and rotatively driven by an unillustrated driving portion and which is further applied with a developing bias voltage by an unillustrated developing bias power source to perform development. In the toner container portions of the respective developers, toners of yellow, magenta, cyan, and black are contained in this order from the upstream side in the sheet delivery direction.

The intermediate transfer member 181, which will be described below, can have a peripheral length of about 2400 mm and rotate at a rotational speed of about 300 mm per second. On its inner side, the primary transfer rollers 124*a*, 124*b*, 124*c*, and 124*d* in contact with the intermediate transfer member 181 are arranged side by side and opposite to the four photosensitive drums 101*a*, 101*b*, 101*c*, and 101*d*, respectively.

These transfer rollers are connected to an unillustrated transfer bias power source. A positive voltage is applied from the transfer rollers, and with this electric field, the negative toner images of the respective colors on the photosensitive drums 101 are successively transferred to the intermediate transfer member 181 in contact with the photosensitive drums 101, to form a color image.

Figure 2:
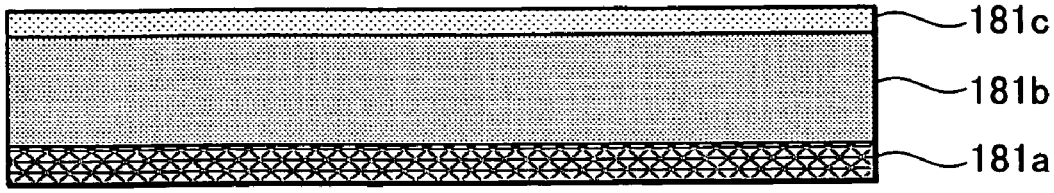
FIG. 2 is a schematic cross sectional view showing a cross section of an intermediate transfer member according to the embodiment of the present invention.

FIG. 2 is a cross sectional view of an example intermediate transfer member 181. In the present invention, the intermediate transfer member 181 includes an elastic intermediate transfer member having an endless form, as described above. The intermediate transfer member 181 is an elastic belt formed of a resin layer 181*a*, an elastic layer 181*b*, and a surface layer 181*c*.

The resin material constituting the resin layer 181*a* can be polycarbonate, fluorine-based resin (ETFE, PVDF), polystyrene, chloropolystyrene, poly-α-methylstyrene and the like. The material however is not limited thereto, but may be, e.g., styrene-butadiene copolymer, styrene-vinyl chloride copolymer, styrene-vinyl acetate copolymer, styrene-maleic acid copolymer, styrene-acrylate copolymer and the like.

Further, the elastic material (elastic rubber, elastomer) constituting the elastic layer 181*b* can be butyl rubber, fluorine-based rubber, acrylic rubber, EPDM, NBR, acrylonitrile-butadiene-styrene rubber, natural rubber and the like. The material however is not limited thereto, but may be, e.g., isoprene rubber, styrene-butadiene rubber, butadiene rubber, ethylene-propylene rubber, ethylene-propylene terpolymer, chloroprene rubber, chlorosulfonated polyethylene and the like Still further, although the material for the surface layer 181*c* is not particularly limited, a material that can reduce adhesion of toner to the surface of the intermediate transfer member 181 and that can increase the efficiency of the secondary transfer is required. For example, polyurethane, polyester, epoxy resin and the like may be used, although it is not limited to these materials.

A conducting agent for adjustment of resistance value is added to the resin layer 181*a* and the elastic layer 181*b*. This conducting agent for resistance value adjustment is not particularly limited. However, it may include metallic powders of carbon black, graphite, aluminum, nickel or the like, those coated with insulative fine particles of tin oxide, titanium oxide, antimony oxide, indium oxide, potassium titanate or the like, although not limited thereto.

A method for producing the intermediate transfer member 181 can be, for example, centrifugal molding to form a belt by introducing a material into a rotating cylindrical mold, spray painting to form a thin film of a surface layer, and dipping to immerse a cylindrical mold in a solution of a material and pulling it up. However, not limited thereto, the belt may be produced by combining a plurality of producing methods.

The color image borne by the intermediate transfer member 181 at the primary transfer portions T1 is further transferred to a sheet of paper P by the secondary transfer roller 140 that is in contact with the intermediate transfer member 181. Specifically, the secondary transfer roller 140 is connected to an unillustrated transfer bias power source, and a voltage of positive polarity is applied from the secondary transfer roller 140 to generate an electric field. With this electric field, the toner images of negative polarity on the intermediate transfer member 181 are transferred to the sheet of paper P in contact with the belt of the intermediate transfer member 181, so that a color image is formed.

Figure 3:
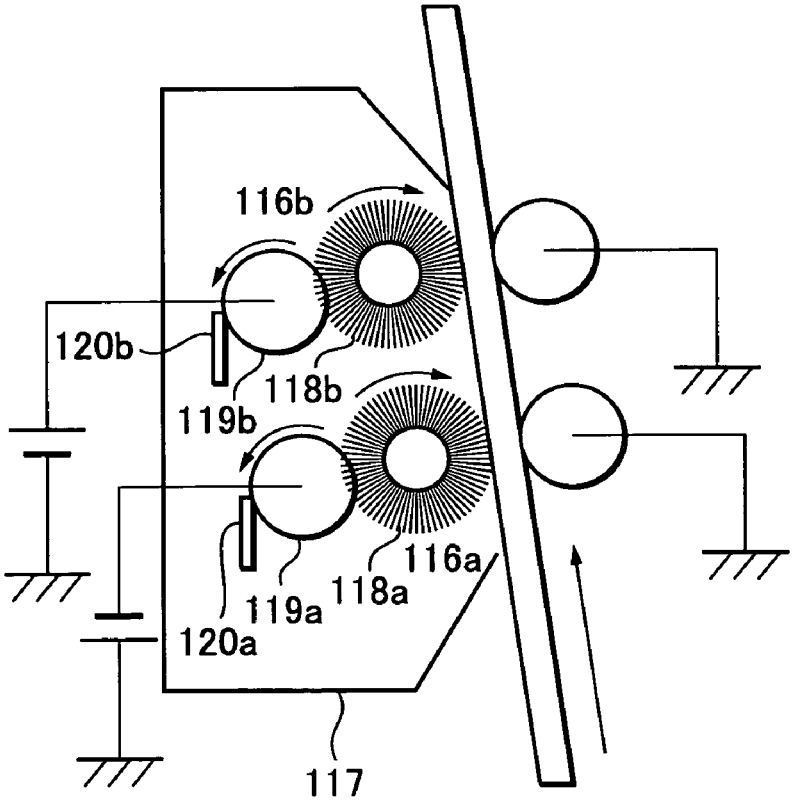
FIG. 3 is a schematic cross sectional view showing an intermediate transfer member cleaning portion according to the embodiment of the present invention.

Hereinafter, a cleaning portion of the transfer residual toner remaining on the intermediate transfer member 181 after the secondary transfer will be described in detail. An electrostatic brush cleaning device has a device housing 117 arranged in the vicinity of the intermediate transfer member 181, as shown in FIG. 3. Electrically conductive fur brushes 118*a* and 118*b* are provided inside device housing 117, in which each brush has bristles of carbon-dispersed nylon fiber implanted on a metallic roller at a prescribed bristle density.

The electrostatic brush cleaning device further has metallic rollers 119*a* and 119*b* made of aluminum with a hard-anodized surface, for example, and cleaning blades 120*a* and 120*b*. The cleaning members configured as above are arranged in parallel with the intermediate transfer member 181, and the first cleaning member 116*a* and the second cleaning member 116*b* constitute the main part of the electrostatic brush cleaning device.

Each electrically conductive fur brush 118 is placed in contact with the intermediate transfer member 181 with the amount of brush invasion being set at about 1.0 mm, and rotated by an unillustrated driving motor in the direction shown by an arrow at the peripheral velocity of about 50 mm/second. The metallic roller is arranged to keep the invasion amount of about 1.0 mm with respect to the electrically conductive fur brush and is rotated in the direction of an arrow at the velocity equal to that of the electrically conductive fur brush. The cleaning blade 120 in contact with the metallic roller can be made of urethane rubber, and is arranged keeping the invasion amount of about 1.0 mm with respect to the metallic roller.

The metallic roller 119*a* of the first cleaning member 116*a* located upstream in the rotational direction of the intermediate transfer member 181 is applied with a direct current voltage of −500 V (with respect to the ground; the same applies hereinafter) by an unillustrated direct current power source. The metallic roller 119*b* of the second cleaning member 116*b* located downstream in the rotational direction of the intermediate transfer member 181 is applied with a direct current voltage of +500 V.

By applying the voltage to the metallic roller 119*a*, there occurs a potential difference with the fur brush 118*a*, which causes the "+" toner within the transfer residual toner on the intermediate transfer member 181 to be attracted and transferred to the fur brush 118*a* side. The toner thus attracted and removed is further transferred from the fur brush 118*a* to the metallic roller 119*a* by the potential difference, which is then scraped off by the cleaning blade 120*a*.

After cleaning of the transfer residual toner on the intermediate transfer member 181 with the first cleaning member 116*a*, there still remains the toner having no polarity and the toner having the "−" polarity on the intermediate transfer member 181. These kinds of toner are charged to "−" by the "−" bias applied to the fur brush 118*a*. This is presumably because of charge injection or discharge.

To remove such toner, cleaning is further performed by applying the "+" bias to the second cleaning member 116*b* located downstream. The removed toner is transferred from the fur brush 118*b* to the metallic roller 119*b*, by the potential difference, and scraped off by the cleaning blade 120*b*. As such, the transfer residual toner remained on the intermediate transfer member 181 can all be removed.

Figure 4:
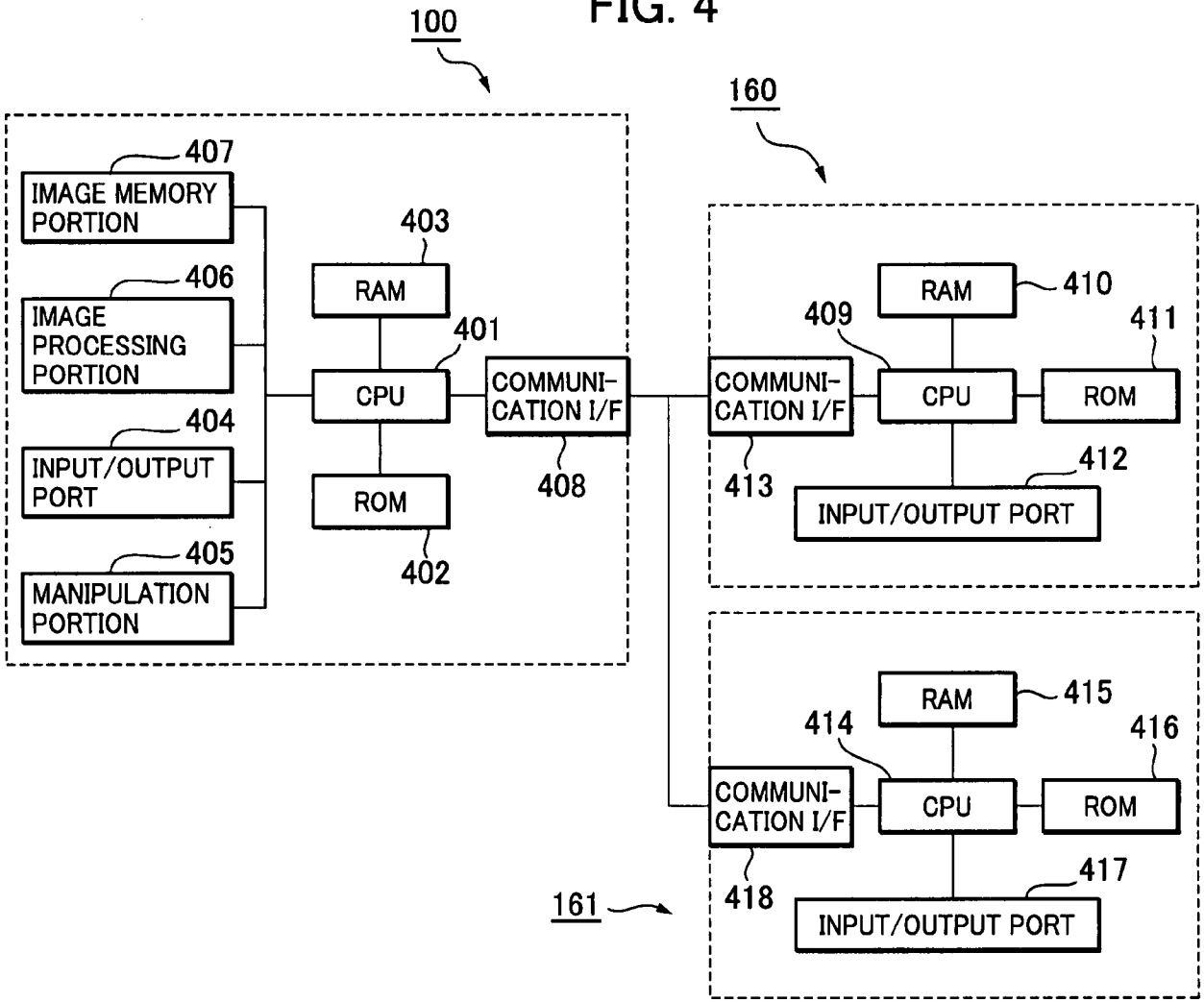
FIG. 4 shows block diagrams of the image forming apparatus and container units according to the embodiment of the present invention.
Figure 5:
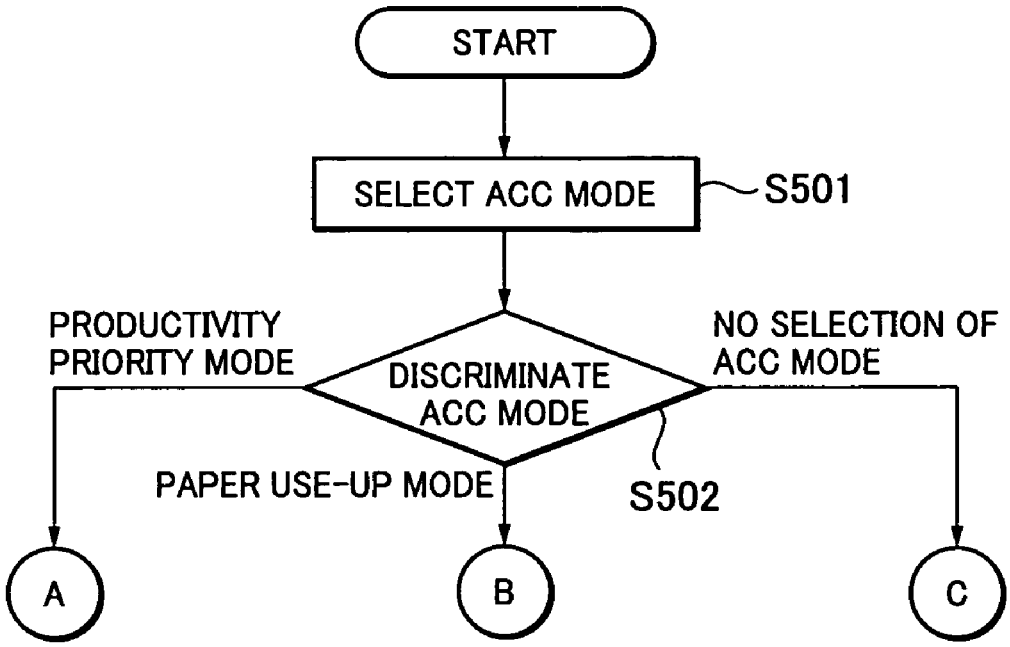
FIG. 5 is a flowchart illustrating details of sheet feeding control in each ACC mode according to the embodiment of the present invention.

FIG. 4 shows block diagrams of the image forming apparatus 100 and the container units 160 and 161. Firstly, the block diagram of the image forming apparatus 100 will be described.

In the control portion of the image forming apparatus 100, a ROM 402 having a control program written therein, a work RAM 403 for performing processing, and an input/output port 404 are connected to a CPU 401 performing basic control, via an address bus and a data bus. A certain area of the RAM 403 constitutes a backup RAM in which data is not erased even after the power is turned off. To the input/output port 404, various load devices such as a motor, a clutch and the like being controlled by the CPU 401, and input devices to the CPU 401 such as a sensor sensing the sheet position and the like, are connected.

The CPU 401 carries out image formation processing by sequentially controlling inputs/outputs via the input/output port 404 in accordance with the content of the control program in the ROM 402. Further, a manipulation portion 405 is connected to the CPU 401. The CPU 401 controls a display portion and a key input portion of the manipulation portion 405. When a user instructs via the key input portion an image formation operating mode or switching of display to the CPU 401, the CPU 401 causes the operational state of the image forming apparatus 100 or the operating mode set by the key input to be displayed on the display portion of the manipulation portion 405.

Further, an image processing portion 406 that processes image data transmitted from a network computer 69 (see FIG. 1), and an image memory portion 407 that stores the processed images are connected to CPU 401. Image forming apparatus 100 is provided with a communication I/F (not shown) for communication with the network computer 69. In the network computer 69, the user can select a mode (productivity priority mode or paper use-up mode, which will be described below) upon the auto cassette change, and the image forming apparatus 100 receives the selected mode via the communication I/F.

The block diagram of the container unit 160 will now be described. A ROM 411 having a control program written therein, a work RAM 410 for performing processing, and an input/output port 412 are connected to a CPU 409 performing basic control, via an address bus and a data bus. A certain area of the RAM 410 constitutes a backup RAM in which data is not erased even after turning the power off. Various load devices such as a motor, a clutch and the like being controlled by the CPU 409, and input devices to the CPU 409 such as a sensor sensing the sheet position and the like, are connected to the input/output port 412.

The CPU 409 sequentially controls inputs/outputs via the input/output port 412 in accordance with the content of the control program in the ROM 411, to carry out processing of separating or conveying sheets in response to a command from the image forming apparatus 100. The CPU 401 of the image forming apparatus and the CPU 409 of the container unit 160 communicate with each other through communication interfaces (I/F) 408 and 413.

The block diagram of the container unit 161 is identical to that of the container unit 160, so that description thereof will not be repeated. The container unit 161 includes a CPU 414, a RAM 415, a ROM 416, an input/output port 417, and a communication I/F 418.

Details of sheet feeding control in each ACC mode will now be described with reference to flowcharts in FIGS. 5-8. The program for this control is stored in the ROM 402 of the image forming apparatus 100, and executed by the CPU 401. Herein, it is assumed that the user has designated in advance to feed sheets from the container unit 160.

Firstly, the user selects the ACC mode (S501). Specifically, the user selects either the productivity priority mode or the paper use-up mode. There is no need to select the ACC mode when it is not executed.

Next, the ACC mode is discriminated (S502). In the case of the productivity priority mode, the process proceeds to step S601 in FIG. 6. In the case of the paper use-up mode, the process proceeds to step S701 in FIG. 7. If the ACC mode is not selected, the process proceeds to step S801 in FIG. 8.

<Productivity Priority Mode>

Figure 6:
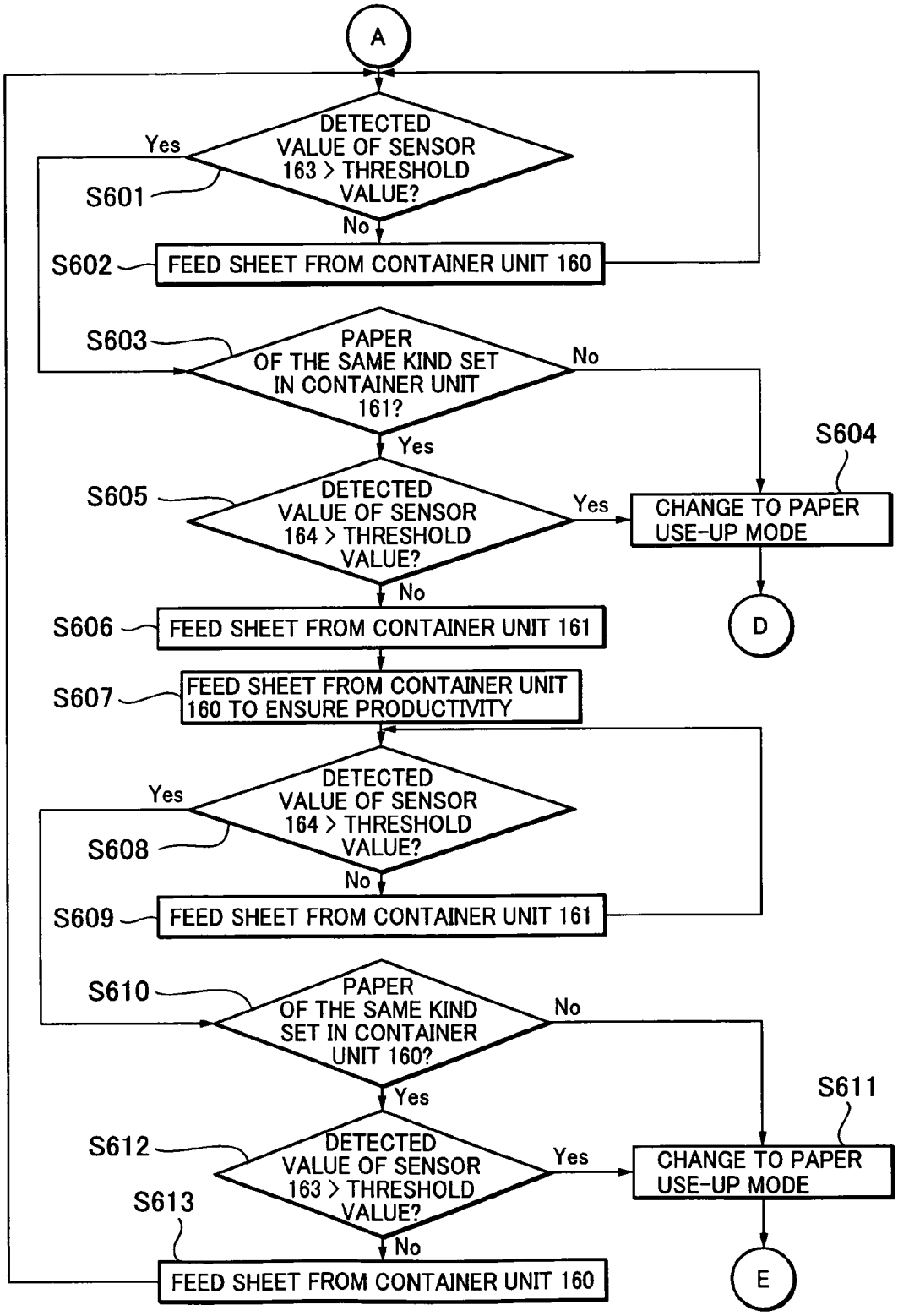
FIG. 6 is a flowchart in the case where a productivity priority mode is selected according to the embodiment of the present invention.

FIG. 6 is a flowchart of sheet feeding control in the productivity priority mode. When the productivity priority mode is selected, the detection level (threshold value) of the sensor 163 within the container unit 160 is changed in accordance with the basic weight of the paper preset in the container unit 160.

Here, various kinds of paper having different basic weights may be contained in the container unit 160 to address the user's need to output images on the sheets of different kinds of paper. At this time, in the case where the sensor 163 detects the remaining amount of sheets in accordance with the weight, if the threshold value of the detection level of the sensor 163 is uniform for all the kinds of paper, the remaining amount of sheets within the container unit detected by the sensor will differ depending on the basic weight of the paper. Naturally, the number of remaining sheets of paper is larger for the paper having a smaller basic weight.

Thus, at the time when the user sets the basic weight of paper, the threshold value of the sensor 163 in the container unit 160 is optimized, so that it is possible in the productivity priority mode to keep the remaining sheets of paper to the smallest possible amount, irrelevant to the basic weight of paper, which can avoid waste of paper.

Firstly, it is determined whether the detected value of the sensor 163 in the container unit 160 exceeds a threshold value set in accordance with the basic weight of paper (S601). That is, it is determined whether the amount of remaining sheets in the container unit 160 is less than a prescribed value. If it is determined in step S601 that it does not exceed the threshold value, a sheet is fed from the container unit 160 by the sheet feeding roller 165 (S602), and the process returns to step S601.

If it is determined in step S601 that it exceeds the threshold value, it is determined whether the paper of the same kind is set in the container unit 161 (S603). If it is determined that the paper of the same kind is not set in the container unit 161, the mode is switched to the paper use-up mode (S604), and the process proceeds to step S702, which will be described below. In this manner, when it is not possible to perform the auto cassette change from the container unit 160 to the container unit 161, the sheets of paper in the container unit 160 are used up. This can prevent interruption of the sheet feeding operation with a prescribed amount of sheets left in the container unit 160.

If it is determined that the paper of the same kind is set in the container unit 161, it is determined whether the detected value of the sensor 164 in the container unit 161 exceeds a threshold value set in accordance with the basic weight of the paper (S605). That is, it is determined whether the amount of remaining sheets in the container unit 161 is less than a prescribed value. If it is determined in step S605 that it exceeds the threshold value, the mode is changed to the paper use-up mode (S604), and the process proceeds to step S702, which will be described below. The reason why the mode is changed to the paper use-up mode is as explained above.

If it is determined in step S605 that it does not exceed the threshold value, a sheet is fed from the container unit 161 by the sheet feeding roller 166 (S606). That is, the auto cassette change from the container unit 160 to the container unit 161 is carried out.

Here, since the container unit 161 is located farther from the image forming apparatus 100 than the container unit 160, simply changing the sheet feeding position to the container unit 161 will lead to an increased inter-sheet gap between the preceding sheet and the following sheet, thereby decreasing productivity. Thus, the sheet feeding from the container unit 160 is performed concurrently with the sheet feeding from the container unit 161 so as to ensure productivity (S607).

Here, it is defined that the sheet transfer time from the container unit 160 to the secondary transfer roller 140 is represented as t1, and the sheet transfer time from the container unit 161 to the secondary transfer roller 140 is represented as t2 ($t1<t2$). At this time, the sheet feeding operation from the container unit 161 is started at the timing that is earlier by ($\Delta t=t2-t1$) than the timing of sheet feeding from the container unit 160. Then, at the time point when the sheet has passed an A point on a sheet delivery path shown in FIG. 1, the sheet feeding operation from the container unit 160 is stopped. The sheet already fed therefrom is delivered to an escape tray 162.

After the auto cassette change is conducted with the sheets left in the container unit 160, the network computer 69 gives a warning of paper exhaustion in the container unit 160, to allow the user to refill the sheets in the container unit.

After the auto cassette change, it is determined whether the detected value of the sensor 164 in the container unit 161 exceeds a threshold value set in accordance with the basic weight of the paper (S608). That is, it is determined whether the amount of remaining sheets in the container unit 161 is less than a prescribed value. If it is determined in step S608 that it does not exceed the threshold value, a sheet is fed from the container unit 161 by the sheet feeding roller 166 (S609), and the process returns to step S608.

If it is determined in step S608 that it exceeds the threshold value, it is determined whether the paper of the same kind is set in the container unit 160 (S610). If it is determined that the paper of the same kind is not set in the container unit 160, the mode is changed to the paper use-up mode (S611), and the process proceeds to step S709, which will be described below. The reason for changing the mode to the paper use-up mode is as described above.

If it is determined that the paper of the same kind is set in the container unit 160, it is determined whether the detected value of the sensor 163 in the container unit 160 exceeds a threshold value set in accordance with the basic weight of the paper (S612). That is, it is determined whether the amount of remaining sheets in the container unit 160 is less than a prescribed value. If it is determined in step S612 that it exceeds the threshold value, the mode is changed to the paper use-up mode (S611), and the process proceeds to step S709, which will be described below, for the same reason as described above.

If it is determined in step S612 that it does not exceed the threshold value, a sheet is fed from the container unit 160 by the sheet feeding roller 165 (S613). That is, the auto cassette change from the container unit 161 to the container unit 160 is carried out.

Here, since the container unit 160 is located closer to the image forming apparatus 100 than the container unit 161, the problem of an increased inter-sheet gap between the preceding sheet and the following sheet leading to degradation of productivity as described above does not occur. Thus, it is unnecessary to perform sheet feeding from the container unit 161 concurrently with the sheet feeding from the container unit 160.

<Paper Use-Up Mode>

Figure 7:
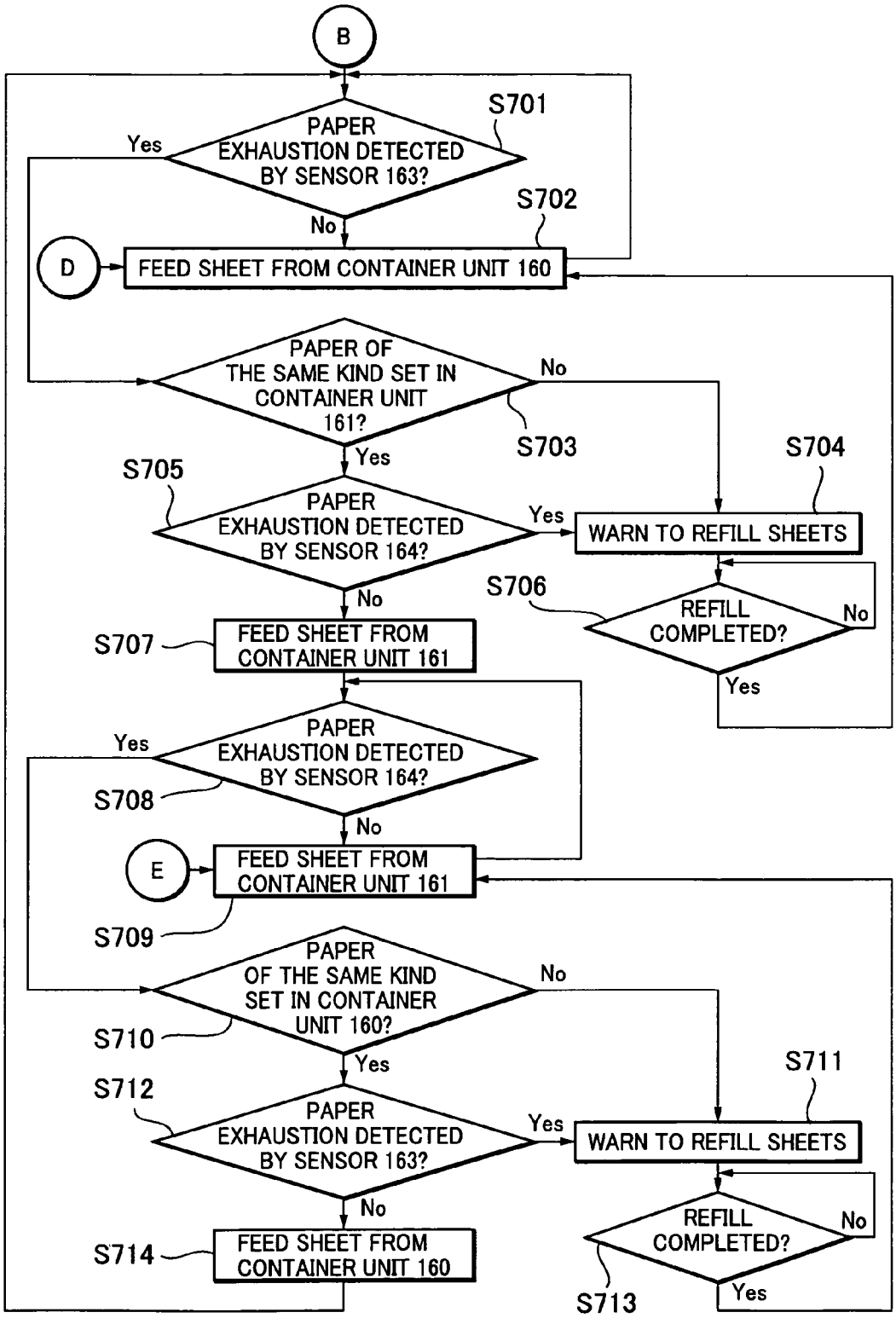
FIG. 7 is a flowchart in the case where a paper use-up mode is selected according to the embodiment of the present invention.

FIG. 7 is a flowchart of sheet feeding control in the paper use-up mode. Firstly, it is determined whether the sensor 163 in the container unit 160 has detected paper exhaustion (S701). If the paper exhaustion is not detected in step S701, a sheet is fed from the container unit 160 by the sheet feeding roller 165 (S702), and the process returns to step S701.

If the paper exhaustion is detected in step S701, it is determined whether the paper of the same kind is set in the container unit 161 (S703). If it is determined that the paper of the same kind is not set in the container unit 161, the warning to refill the sheets is displayed on the display portion of the network computer 69 (S704), and there is a wait for the user to refill the sheets in container unit 160 (S706). When the sheets are refilled, the process returns to step S702, where a sheet is fed from the container unit 160 by the sheet feeding roller 165.

If it is determined that the paper of the same kind is set in the container unit 161, it is determined whether the sensor 164 in the container unit 161 has detected paper exhaustion (S705). If the paper exhaustion is detected in step S705, the process proceeds to step S704. If the paper exhaustion is not detected in step S705, a sheet is fed from the container unit 161 by the sheet feeding roller 166 (S707). That is, the auto cassette change from the container unit 160 to the container unit 161 is carried out.

After the auto cassette change is performed in the state where the sheets in the container unit 160 have all been used up, the network computer 69 gives the warning of paper exhaustion in the container unit 160, to allow the user to refill the sheets in the container unit 160.

Here, while the sheet fed from the container unit 161 has an increased inter-sheet gap with the preceding sheet, the next image has already been formed on the intermediate transfer member 181 at a normal interval. This means that the image cannot be transferred to the sheet fed from the container unit 161 unless any measure is taken. Thus, the process moves to an ACC down sequence operation, which will be described below in detail.

After the auto cassette change by the ACC down sequence is performed, it is determined whether the sensor 164 in the container unit 161 has detected paper exhaustion (S708). If the paper exhaustion is not detected in step S708, a sheet is fed from the container unit 161 by the sheet feeding roller 166 (S709), and the process returns to step S708.

If the paper exhaustion is detected in step S708, it is determined whether the paper of the same kind is set in the container unit 160 (S710). If it is determined that the paper of the same kind is not set in the container unit 160, the warning to refill the sheets is displayed on the display portion of the network computer 69 (S711), and there is a wait for the user to refill the sheets in the container unit 161 (S713). When the sheets are refilled, the process returns to S709, where a sheet is fed from the container unit 161 by the sheet feeding roller 166.

If it is determined that the paper of the same kind is set in the container unit 160, it is determined whether the sensor 163 in the container unit 160 has detected paper exhaustion (S712). If the paper exhaustion is detected in step S712, the process proceeds to step S711. If the paper exhaustion is not detected in step S712, a sheet is fed from the container unit 160 by the sheet feeding roller 165 (S714). That is, the auto cassette change from the container unit 161 to the container unit 160 is carried out.

Here, since the container unit 160 is located closer to the image forming apparatus 100 than the container unit 161, the above-described problem of an increased inter-sheet gap between the preceding sheet and the following sheet does not occur. Thus, the ACC down sequence is not carried out here.

<No Selection of ACC Mode>

Figure 8:
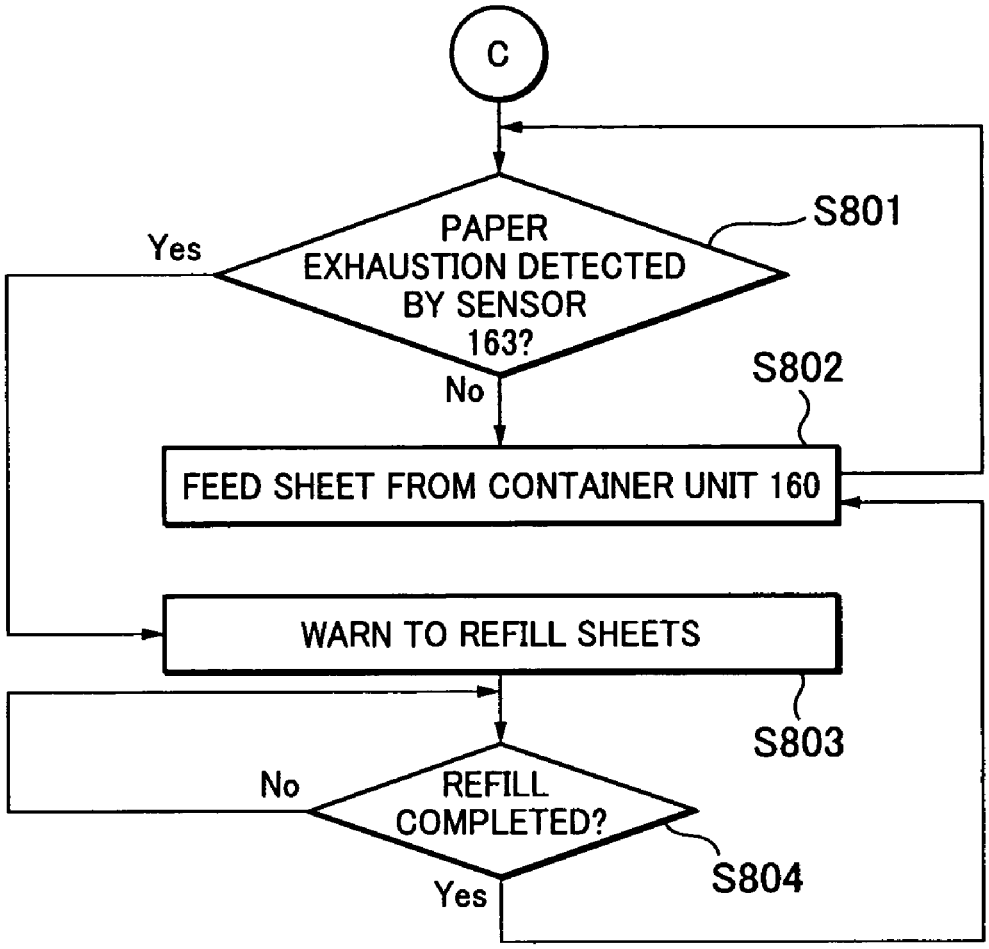
FIG. 8 is a flowchart in the case where there is no selection of the ACC mode according to the embodiment of the present invention.

FIG. 8 is a flowchart of sheet feeding control when the ACC mode is not selected. Firstly, it is determined whether the sensor 163 in the container unit 160 has detected paper exhaustion (S801). If the paper exhaustion is not detected in step S801, a sheet is fed from the container unit 160 by the sheet feeding roller 165 (S802), and the process returns to step S801.

If the paper exhaustion is detected in step S801, the warning to refill the sheets is displayed on the display portion of the network computer 69 (S803), and there is a wait for the user to refill the sheets in the container unit 160 (S804). When the sheets are refilled, the process returns to step S802, where a sheet is fed from the container unit 160 by the sheet feeding roller 165.

The above description was made assuming that the user sets in advance to feed the sheets from the container unit 160, for the sake of simplicity in explanation of the present embodiment. However, it is of course possible to set in advance to feed the sheets from the container unit 161.

<ACC Down Sequence>

Figure 9:
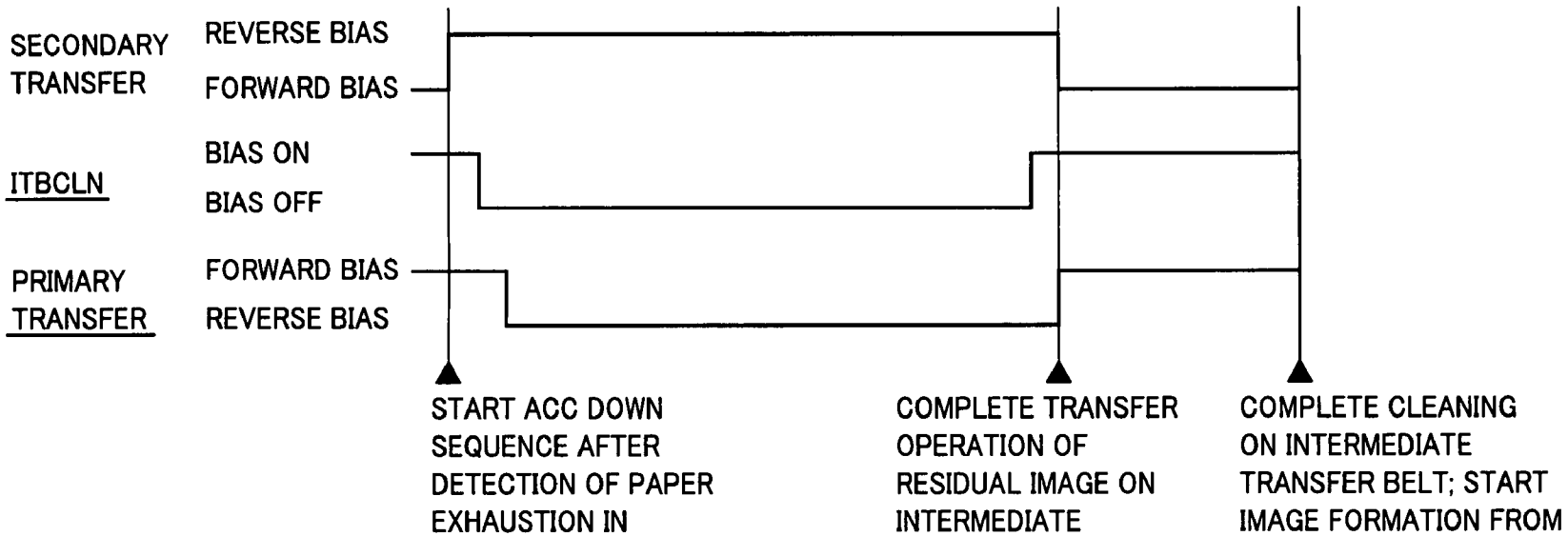
FIG. 9 is a detailed diagram of an ACC down sequence at the time of single-sided printing according to the embodiment of the present invention.

Details of the ACC down sequence in the case of image formation for single-sided printing are shown in FIG. 9. At the time point when the sensor 163 detects paper exhaustion, the secondary transfer roller 140 switches the applied voltage upon image formation from the normal voltage of −2000 V to the reverse voltage of 2000 V. By switching the polarity of the applied voltage of the secondary transfer roller 140, the image formed on the intermediate transfer member 181 is refrained from being transferred at the secondary transfer portion, and remains on the intermediate transfer member 181. The bias applied to the metallic roller 119 is turned OFF corresponding to the timing when the image passes through the intermediate transfer member cleaning portion 116.

By turning the bias OFF, the image remains intact when it passes through the intermediate transfer cleaning portion. The image having passed intact through the intermediate transfer cleaning portion can be transferred back onto the photosensitive member 101 by switching the primary transfer roller 124 from +1000 V, which is the voltage normally applied upon image formation, to −1000 V. Since there are four primary transfer portions, the intermediate transfer member 181 only needs to go round one time so as to completely transfer the images remaining on the belt.

Thereafter, the voltages applied to the primary transfer roller 124 and the secondary transfer roller 140 are returned to +1000 V and −2000 V, respectively, of the normal levels upon image formation. The intermediate transfer cleaning portions are also applied with voltages, so as to clean the images remaining on the intermediate transfer member 181 in small amount. At the time point when the cleaning is finished for a whole round of the belt, the sheet feeding operation from the container unit 161 by the sheet feeding roller 166 is started.

For cleaning of the intermediate transfer member 181, if electrostatic fur brush cleaning or the like for performing cleaning in an electrostatic manner is employed, cleaning capacity is lower than in the case of cleaning by mechanical scraping force as represented by the blade method. Thus, it is difficult to clean the image formed on the intermediate transfer member 181 but not transferred at the secondary transfer portion in a short period of time. Accordingly, the primary transfer portions are used to transfer the untransferred images to the photosensitive drums (image bearing members). Cleaning is carried out with the cleaning devices of the blade type on the photosensitive drums, and then the cleaning member for the intermediate transfer member is activated. In this manner, the down time can be made as short as possible.

Figure 10:
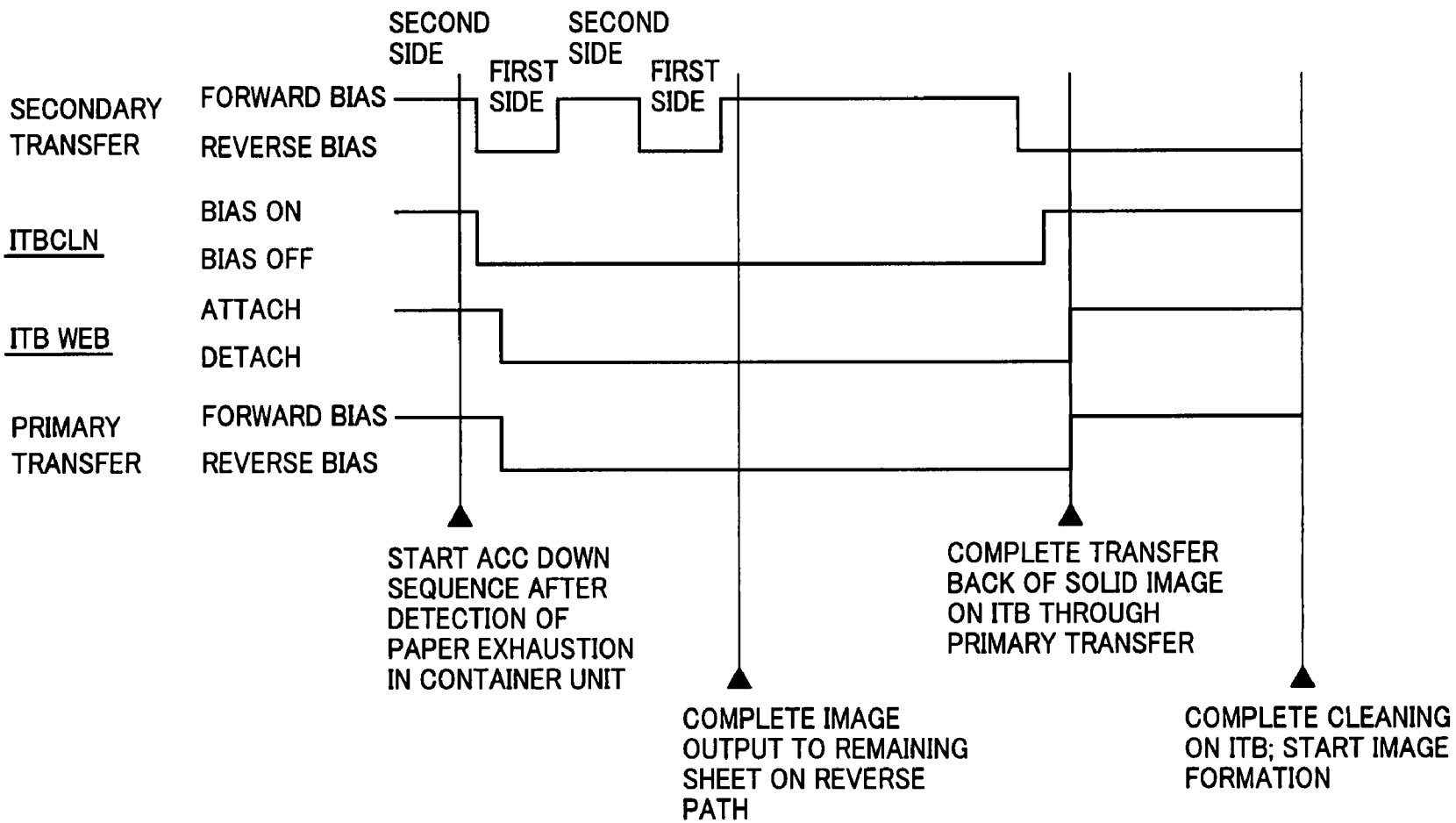
FIG. 10 is a detailed diagram of an ACC down sequence at the time of double-sided printing according to the embodiment of the present invention.

Details of the ACC down sequence in the case of image formation for double-sided printing are shown in FIG. 10. At the time of double-sided printing, images on the first side and on the second side are formed alternately. On a sheet fed from the container unit 160, the image of the first side is firstly transferred by the secondary transfer roller 140. The sheet then passes through a reverse path 182, so that it is reversed. The image of the second side is transferred again by the secondary transfer portion, so that the double-sided printing is complete.

At the time point when the sensor 163 detects paper exhaustion in the container unit 160, a plurality of sheets having the printing on only the first side completed exists on the reverse path 182. Thus, it is necessary to stop the sheet feeding operation, and to transfer the image on the second side to the sheets existing on reverse path 182, even after the start of the ACC down sequence, so as to complete the image output.

To this end, it is configured such that when the image of the second side passes through the secondary transfer roller 140, −2000 V is applied thereto to transfer the image. Whereas when the image of the first side passes through the secondary transfer portion, the voltage of the reverse polarity, +2000 V, is applied thereto to cause the image to remain on the intermediate transfer member 181. By doing these operations alternately, image formation for the sheets remaining on the reverse path 182 can all be completed, while the image of the first side on the intermediate transfer member 181 can be passed intact therethrough.

The image having passed intact through the secondary transfer roller 140 is also passed intact through the intermediate transfer cleaning portion by turning OFF the applied voltage of the cleaning portion, as in the case of the single-sided printing. Further, the image having passed intact through the secondary transfer roller 140 is transferred back to the photosensitive members by applying the reverse bias of −1000 V at the primary transfer rollers 124.

Thereafter, the applied voltages of the primary transfer rollers 124 and the secondary transfer roller 140 are returned to +1000 V and −2000 V, respectively, which are the normally applied voltages upon image formation. Voltages are also applied to the intermediate transfer cleaning portions to clean the remaining images on the intermediate transfer member 181 in small amount. At the time point when cleaning is finished for a whole round of the belt, the sheet feeding operation from the container unit 161 by the sheet feeding roller 166 is started. After the auto cassette change is carried out in the state where the sheets in the container unit 160 are all used up, the network computer 69 issues a warning of paper exhaustion in the container unit 160 to allow the user to refill the sheets in the container unit.

Although the image forming apparatus 100 has been explained as a printer in the present embodiment, it may be a copying machine provided with a reader having the function of reading originals.

Further, although it has been configured such that the user selects the productivity priority mode or the paper use-up mode upon auto cassette change from the network computer 69, it is of course possible to select it via the manipulation portion 405 provided at the image forming apparatus 100.

As described above, according to the present embodiment, if the user wishes to give priority to productivity, he/she can select via the manipulation portion 405 or the network computer 69 the productivity priority mode where the container units are changed in the state where a prescribed amount of sheets remain in the container unit. If the user wishes to perform the auto cassette change after all the sheets in the container unit are used up, the user can select the paper use-up mode. That the user can select the mode of auto cassette change enables use of the apparatus in accordance with the user's intended purpose.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Laid-Open No. 2005-251650, filed Aug. 31, 2005, which is hereby incorporated by reference herein in its entirety.

What is claimed is:

1. An image forming apparatus comprising:

a plurality of container units adapted to contain sheets, the plurality of container units including a currently in-use container unit and another container unit;

a sheet feeding device provided for each of the plurality of container units and configured to feed the sheets contained in the respective container unit; and a controller switching between modes including a first mode and a second mode in order to automatically switch a sheet feeding position from the currently in-use container unit to the other container unit, wherein in the first mode, the sheet feeding position is switched to the other container unit in the state in which a prescribed amount of sheets are left in the currently in-use container unit, and wherein in the second mode, the sheet feeding position is switched to the other container unit after the sheets in the current in-use container unit are exhausted.

2. The image forming apparatus according to claim 1, wherein when an amount of sheets remaining in the currently in-use container unit has reached the prescribed amount during the first mode, the controller switches from the first mode to the second mode if there is no other container unit of the plurality of container units containing the same kind of sheets as those contained in the currently in-use container unit.

3. The image forming apparatus according to claim 2, wherein when the amount of sheets remaining in the currently in-use container unit has reached the prescribed amount during the first mode, the controller switches from the first mode to the second mode, even if there is another container unit containing the same kind of sheets as those contained in the currently in-use container unit, if an amount of sheets remaining in the other container unit has reached the prescribed amount.

4. The image forming apparatus according to claim 1, further comprising:

a receiving device configured to receive information indicating one of the first mode and the second mode from the outside, wherein the controller switches between the first and second modes in accordance with the information received by the receiving device.

5. The image forming apparatus according to claim 1, further comprising:

a setting device allowing a user to set the mode to one of the first mode and the second mode, wherein the controller switches between the first and second modes in accordance with the mode set by the user via the setting device.

6. The image forming apparatus according to claim 1, wherein the prescribed amount is based on a basic weight of the sheets set by the user.

7. The image forming apparatus according to claim 1, further comprising:

a plurality of image bearing members each having a surface on which a toner image is formed;

an intermediate transfer member;

a plurality of primary transfer devices transferring the toner images on the plurality of image bearing members to the intermediate transfer member during a primary transfer;

a secondary transfer device transferring to a sheet the toner images on the intermediate transfer member during a secondary transfer;

an intermediate transfer member cleaning device cleaning transfer residual toner remaining on the intermediate transfer member after the toner images are transferred to the sheet by the secondary transfer device; and an image bearing member cleaning device cleaning the image bearing member.

8. The image forming apparatus according to claim 7, wherein when the sheets in the currently in-use container unit are exhausted during the second mode, the controller causes the sheet feeding device to temporarily stop feeding sheets, causes the secondary transfer device and the intermediate transfer member cleaning device to stop the secondary transfer and cleaning, respectively, causes the primary transfer devices to transfer the toner images formed on the intermediate transfer member to the image bearing members, and causes the intermediate transfer member cleaning device to clean the intermediate transfer member.

9. The image forming apparatus according to claim 7, wherein the intermediate transfer member includes an elastic layer at a surface layer portion.

10. The image forming apparatus according to claim 7, wherein the intermediate transfer member cleaning device includes an electrically conductive fur brush, and wherein the image bearing member cleaning device includes a cleaning blade.

11. The image forming apparatus according to claim 7, wherein the intermediate transfer member cleaning device includes at least a first cleaning portion and a second cleaning portion, and wherein biases of different polarities are applied to the first and second cleaning portions.

12. The image forming apparatus according to claim 11, wherein the first cleaning portion is arranged between the secondary transfer device and the primary transfer device, on a downstream side of the secondary transfer device in a moving direction of the intermediate transfer member, wherein the second cleaning portion is arranged between the secondary transfer device and the primary transfer device, on a downstream side of the first cleaning portion in the moving direction of the intermediate transfer member, and wherein a bias of a polarity that is the same as a polarity of toner is applied to the first cleaning portion, and a bias of a polarity that is different from the polarity of the toner is applied to the second cleaning portion.

13. A control method of an image forming apparatus having a plurality of container units containing sheets, including a currently in-use container unit and another container unit, and a sheet feeding device provided for each of the plurality of container units and configured to feed the sheets contained in the respective container unit, comprising:

controlling switching between a first mode and a second mode in order to automatically switch a sheet feeding position from the currently in-use container unit to the other container unit, wherein in the first mode, the sheet feeding position is switched to the other container unit in the state in which a prescribed amount of sheets are left in the currently in-use container unit, and wherein in the second mode, the sheet feeding position is switched to the other container unit after the sheets in the currently in-use container unit are exhausted.

* * * * *